United States Patent [19]

Legler

[11] Patent Number: 4,830,184

[45] Date of Patent: May 16, 1989

[54] METAL WIRE SPACER FOR USE IN THE BUNDLING OF NESTED STACKS OF METAL PIECES

[75] Inventor: Steve Legler, Westmount, Canada

[73] Assignee: Tri-Steel Industries Inc., Quebec, Canada

[21] Appl. No.: 184,137

[22] Filed: Apr. 21, 1988

[51] Int. Cl.[4] ..... B65D 71/00; B65D 85/20

[52] U.S. Cl. ..... 206/442; 53/444; 53/447; 206/443; 206/821

[58] Field of Search ..... 53/443, 444, 447; 29/527.2, 527.3; 108/25, 91; 140/73, 92.1, 93, 93 B, 123; 206/442, 443, 446, 321, 521, 594, 814, 821; 211/181; 428/364, 379, 389

[56] References Cited

U.S. PATENT DOCUMENTS

| | | | |
|---|---|---|---|
| 1,921,228 | 8/1933 | Hetherington | 206/443 |
| 3,517,606 | 6/1970 | Myles et al. | 211/181 |
| 4,605,598 | 8/1986 | Thomas et al. | 428/379 |

FOREIGN PATENT DOCUMENTS

| | | | |
|---|---|---|---|
| 0734075 | 5/1980 | U.S.S.R. | 53/447 |

*Primary Examiner*—Jimmy G. Foster

*Attorney, Agent, or Firm*—Oblon, Fisher, Spivak, McClelland & Maier

[57] ABSTRACT

A preformed wire spacer for spacing nested formed galvanized metal material pieces having a nestable profile and wherein at least two stacks of the nested material pieces are disposed and secured in side-by-side relationship to form a bundle. The spacer comprises a metal wire treated with a corrosive resistant coating and formed of similar profile as the cross-section of at least part of the profile of two of the material pieces when positioned in side-by-side relationship. The spacer has a cross-section to provide reduced contact with the surface of opposed nested ones of the pieces when positioned therebetween whereby to provide air flow and minimum water retention between the nested material pieces to substantially reduce the formation of white rust.

14 Claims, 2 Drawing Sheets

METAL WIRE SPACER FOR USE IN THE BUNDLING OF NESTED STACKS OF METAL PIECES

BACKGROUND OF THE INVENTION

1. Field of the Invention

The present invention relates to spacers to be used between nested galvanized metal pieces positioned one on top of another, such as elongated angle iron pieces, with stacks of such pieces being positioned side-by-side and strapped to form a bundle.

2. Description of Prior Art

When shipping elongated pre-formed galvanized metal pieces having a nestable profile, it is customary to stack these metal pieces one on top of another to form stacks and then to bundle these stacks side by side. It is also customary to provided an insert between each nested piece so that air can circulate between these pieces and water drained therefrom whereby to prevent the formation of white rust between the nested pieces in the bundle. This was accomplished by providing wooden inserts between the nested metal pieces but this practice is now substantially discontinued for the reason that wood absorbs moisture and still produced rust in the area where the wood pieces were positioned. It is usually the practice to stack these profile pieces with their peaks facing up so that water will drain downwards during shipping.

In order to attempt to overcome the abovementioned disadvantage of the use of wooden inserts, there is now provided small preformed plastic pieces of like profile as the nested material pieces and which fits in the crest of the nested pieces. These plastic inserts are provided with opposed flat surfaces to provide good contact with the metal pieces so that the inserts do not fall out. However, there are several problems with these small plastic inserts and one is that they are timeconsuming to install as they have a tendency to fall off, due to their small sizes. Also, because they are constructed of plastic, they tend to compress when subjected to a heavy load. Still further, it is not possible to make a high stack with these plastic inserts as the stack will bend due to its instability created by the small plastic inserts provided in the nested crest portions. A still further disadvantage is that by using plastic inserts, the inserts soften at high temperatures and compress even more. When subjected to cold temperatures, the plastic inserts become brittle and often break by vibrations imparted to the bundle. Thus, there results metal-to-metal contact and corrosion can take place. When the plastic inserts compress, the strappings of the bundle also become loose and the metal pieces within the load start shifting causing damage to the surroundings and are particularly hazardous during transportation of such bundle on a flat-bed truck or on a ship where the metal pieces can become loose or fall off a truck. Accordingly, the use of such plastic pieces has not been found to be adequate, particularly when shipping bundles for long distances where the bundle is exposed to salt-water spray.

A still further method has been utilized in order to prevent stacks of nested elongated metal pieces from bending to permit higher stacks to be formed. That method comprised inverting one or more metal angle pieces between opposed stacks, and at spaced intervals, whereby to bridge the stacks and provide better stacking of a bundle. A disadvantage of using inverted metal pieces throughout the bundle is that these pieces then act as troughs in which water can be collected and these pieces will quickly rust, particularly when exposed to salt-water spray such as on ships or on flat-bed trucks when displaced over roadways which have been salted during winter seasons. Also, the adjacent metal pieces which engage with this inverted piece also rust and this rust will flow down into the bundle. Accordingly, this method has also not been found adequate for shipping these bundles in an environment where there is salt-water spray.

SUMMARY OF THE INVENTION

It is a feature of the present invention to provide an improved spacer for spacing nested formed galvanized metal material pieces having a nestable profile and wherein the pieces are stacked one on top of another to form stacks with at least two stacks of the nested material pieces being disposed and secured in side-by-side relationship to form a bundle and wherein the spacer is formed of a wire having a shape of similar profile as the cross-section of at least part of the profile of two of the material pieces positioned side by side and wherein the spacer wire has a corrosive resistant coating.

Another feature of the present invention is to provide an improved metal wire spacer as above described and wherein the cross-section of the spacer provides reduced contact with the surface of opposed nested ones of the galvanized metal pieces.

Another feature of the present invention is to provide an improved metal spacer as above described which is a pre-formed metal wire of circular cross-section and wherein the wire is galvanized and treated with a chromate solution.

Another feature of the present invention is to provide an improved method of making a bundle of elongated metal channel pieces of nestable profile to substantially reduce the formation of white rust between the galvanized metal pieces and wherein the bundle is formed with a plurality of spacers formed by pre-formed lengths of metal wire of similar profile as the cross-section of at least part of the profile of two adjacent channel pieces when positioned side-by-side and wherein the wire spacer has a corrosive resistant coating.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
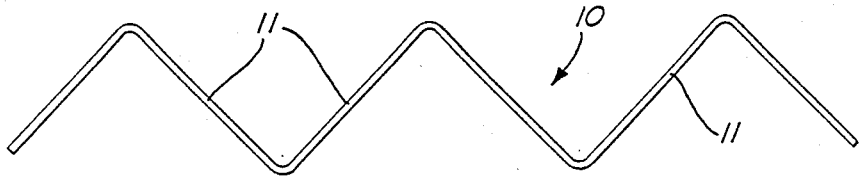
FIG. 1 is a side view of the pre-formed metal wire spacer of the present invention.
Figure 2:
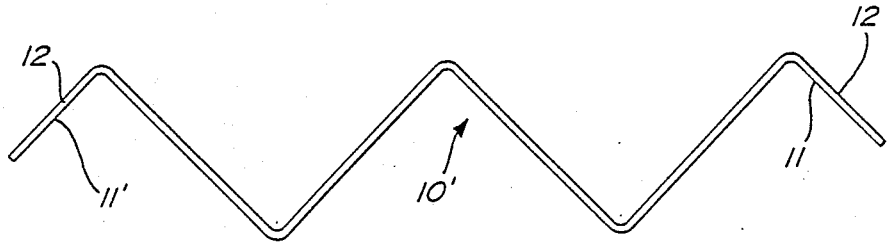
FIG. 2 is a side view of a slightly modified preformed wire spacer of the present invention.
Figure 5:
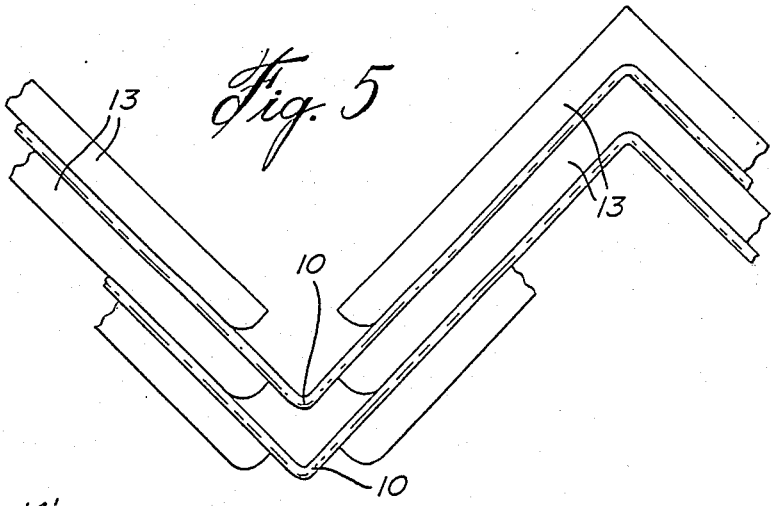
FIG. 5 is an enlarged view showing the area between opposed side-by-side stacks of metal material pieces with the wire spacer extending therebetween.

Referring now to the drawings, and more particularly to FIGS. 1 and 2, there is shown the construction of the wire spacer of the present invention. As shown in FIG. 1, the wire spacer 10 is formed from a single wire piece, such as a steel wire, which is galvanized, and formed with a similar profile as the cross-section of at least part of the profile of two material pieces to be positioned side-by-side in the bundle. Herein, the cross-section of material pieces would be of triangular shape. Thus, the wire is formed with a series of right angle triangular profiles or triangles 11. In order to enhance the corrosive resistance of the galvanized wire, it may also be treated with a chromate solution after the galvanizing process and while the wire is still hot. Also, in order to provide reduced contact with the surface of opposed nested metal material pieces, as will be described later, the wire is formed with a cross-section to reduce contact with the surface of opposed nested ones of these metal pieces, and as more clearly shown in FIG. 5, these wires are formed with a circular cross-section.

FIG. 2 illustrates a slight variation of the wire spacer of FIG. 1 and as herein shown, the spacer 10' has the end ones of its triangular profiles 11' provided with an outer arm 12 which is terminated shorter than the remaining arms of the triangular profiles so that when positioned between stacks of nested metal pieces, the outer arms will not extend to the edge or out of a bundle.

Figure 3:
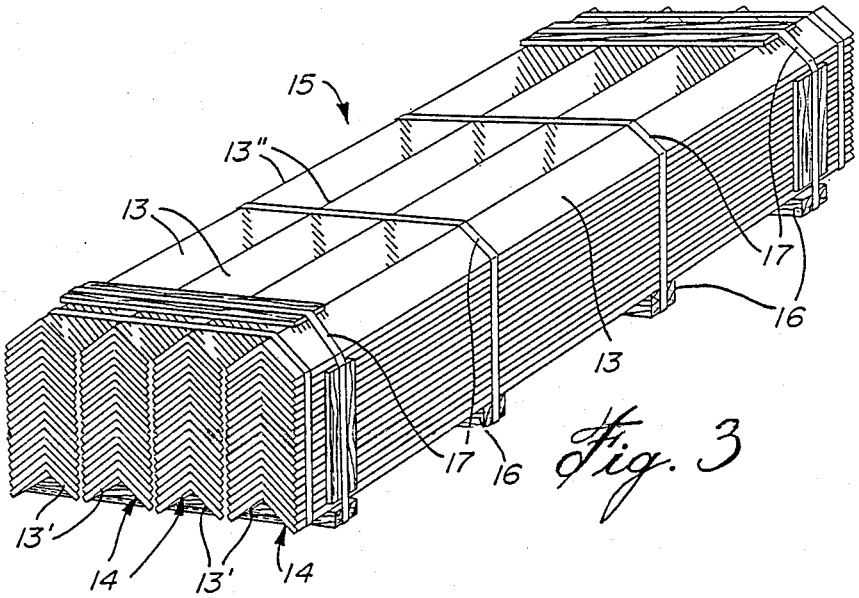
FIG. 3 is a perspective view showing a bundle of nested metal material pieces incorporating the wire spacer of the present invention.
Figure 4:
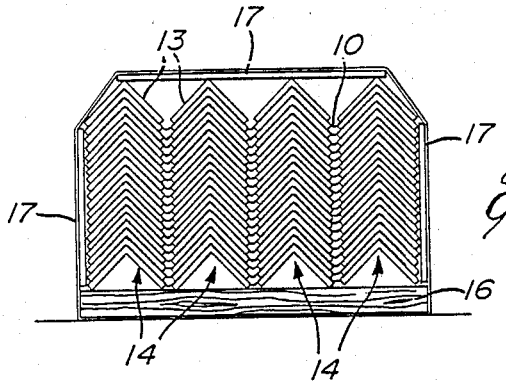
FIG. 4 is an end view of FIG. 3.
Figure 6:
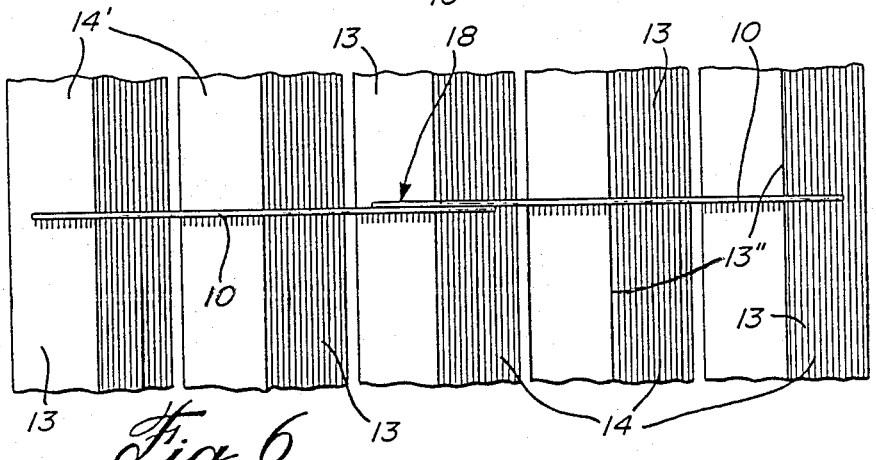
FIG. 6 is a top fragmented view of a bundle showing the disposition of aligned wire spacers of the present invention.

As shown in FIG. 3, there is provided a bundle 15 formed from a plurality, herein four, of adjacent stacks 14 of elongated right angle metal pieces 13 which are nested one on top of the other. Each of the metal pieces 13 are stacked with a pre-formed wire spacer 10 disposed between adjacent metal pieces 13, as is more clearly shown in FIGS. 4 and 5. Accordingly, in order to form the stack as shown in FIG. 3, the wooden support studs 16 are first placed on a floor surface and the bottom layer 13' of the metal pieces 13 are positioned in side-by-side relationship with their peaks 13'' extending upwardly so as to permit water to flow downwardly out of the stack. A plurality of wire spacers 10 of the present invention are then disposed transversely across the bundle and at spaced intervals along the length of the bottom layer 13'. As herein shown, spacers are provided at four locations and substantially in the areas where the metal straps 17 are disposed. The spacer is also preferably provided with four triangular peaks to span the entire width of the bundle. Alternatively, these may be formed with three peaks as shown in FIG. 1 or as shown in FIG. 2 with two of these metal wires, and are aligned across the width of the bundle disposed with at least an end one of its triangular profile, such as the end profiles 11', overlapped in side-by-side relationship, as shown at 18 in FIG. 6. Also, as shown in FIG. 6, there are five rows of stacks 14'.

After these wire spacers are positioned over the bottom row 13', a second row of metal pieces 13 are disposed over the wires and nested with the bottom row. Accordingly, the wire spacers are rigidly in place and provide retention of the metal pieces transversely of the bundle. Additional wire spacers are positioned on top of the second row and a third row of metal pieces are then positioned over these and so on. Because the wires form attachments transversely of the bundle being formed, it is possible to form bundles having very high stacks without having to invert metal pieces in the area between each bundle, thus causing white rust, as previously described. Also, because the metal wires will not compress when subjected to loading once the bundle is strapped, it will remain rigid during transportation. Still further, because the spacers are formed with a cross-section having only small surface contact with the nested metal pieces, there will be good aeration between the metal pieces and any water lodging therebetween will not be trapped and flow out of the bundle by gravity or by air flow.

Although the wire spacer of the present invention was developed for use in making a bundle of galvanized metal channel pieces of nestable profile whereby to substantially reduce the formation of rust, such as white rust when transporting galvanized angle iron pieces, it is intended to cover any obvious modifications of the present invention, provided such modifications fall within the scope of the appended claims. For example, the profile of the wire spacer may have any desired profile depending on the cross-section of the metal pieces, provided such metal pieces have a nestable profile. For example, the profile could be arcuate, semi-circular, or have flat walls with flared side walls, etc. The cross-section profile of the wire may also have many configurations.

I claim:

1. A wire spacer for spacing nested formed or shaped galvanized metal pieces having a nestable profile and wherein at least two opposed stacks of said nested material pieces are disposed and secured in side-by-side relationship to form a bundle, said spacer comprising a metal wire treated with a corrosive resistant coating and formed of similar profile as the cross-section of at least part of the profile of two of said material pieces positioned side by side, said spacer having a cross-section to provide reduced contact with the surface of opposed nested ones of said pieces when positioned in contact therebetween whereby to provide air flow and minimum water retention between said nested material pieces to substantially reduce the formation of white rust, said spacer also extending between said opposed stacks to maintain said stacks connected together by a plurality of said wire rods.

2. A wire spacer as claimed in claim 1 wherein said spacer is a pre-formed metal wire of circular cross-section.

3. A wire spacer as claimed in claim 2 wherein said pre-formed metal wire is a galvanized wire.

4. A wire spacer as claimed in claim 2 wherein said pre-formed metal wire is formed to define a continuous series of right angle triangular profiles for nesting transversely between opposed ones of elongated channel pieces of right angle cross-section and nested with one another to form a stack.

5. A wire spacer as claimed in claim 4 wherein two or more of said preformed metal wires are disposed between common nested ones of said nested pieces and spaced apart along the length of said channel pieces to provide longitudinal support spacing between said common opposed nested ones of said channel pieces.

6. A wire spacer as claimed in claim 5 wherein there are two or more of said preformed metal wires aligned across the width of said bundle and each disposed with at least an end one of its triangular profile overlapped in side-by-side relationship with an end one of the triangular profile of an aligned preformed metal wire.

7. A wire spacer as claimed in claim 5 wherein said bundle is held together by transverse exterior wrap-around straps disposed at spaced intervals, said spacers being held in position by the compression force exerted by the weight of said pieces in said bundle.

8. A wire spacer as claimed in claim 4 wherein said series of triangular profiles are terminated with a shorter arm section at opposed ends thereof to terminate short of outer stacks of metal material pieces in a bundle.

9. A wire spacer as claimed in claim 2 wherein said pre-formed metal wire has a length which spans the full width of said bundle.

10. A method of making a bundle of elongated galvanized metal channel or angle pieces of nestable profile to substantially reduce the formation of white rust between said metal pieces, said method comprising the steps of:

(i) providing a plurality of spacers formed by preformed lengths of metal wire of similar profile as the cross-section of at least part of the profile of two of said channel pieces when positioned side by side, said metal wire having a corrosive resistant coating, (ii) nesting two or more stacks of said pieces side by side, (iii) simultaneously positioning at least two of said preformed lengths of metal wire transversely across opposed ones of said channel pieces of said stacks and spaced lengthwise of said channel pieces, and (iv) strapping said opposed stacks to form a bundle, said spacers providing air flow and minimum water retention between said nested material pieces to substantially reduce the formation of white rust.

11. A method as claimed in claim 10 wherein said step (ii) comprises positioning a plurality of said stacks side by side, said preformed lengths of metal wire spanning said bundle.

12. A method as claimed in claim 10 wherein said step (ii) comprises positioning a plurality of said stacks side by side, and said step (iii) comprises positioning two or more of said preformed metal wires across the width of said bundle and each disposed with at least an end one of its profile overlapped in side-by-side relationship with the profile of an end of another aligned pre-formed metal wire.

13. A method as claimed in claim 10 wherein said step (i) comprises forming said pre-formed metal wire with steel wire of circular cross-section, and galvanizing said wire.

14. A method as claimed in claim 13 wherein said metal pieces are elongated right angle channel pieces; said spacers substantially reducing the accumulation of salt water sprayed thereon during transportation of said bundle by permitting improved aeration between each nested piece whereby to substantially reduce the formation of white rust.

* * * * *